US007281458B2

(12) United States Patent
Chuang

(10) Patent No.: US 7,281,458 B2
(45) Date of Patent: Oct. 16, 2007

(54) TRANSMISSION MEMBER WITH TORQUE-RESTRICTING PROTECTIVE STRUCTURE

(76) Inventor: Chia-Chiung Chuang, 3F, No. 22, Lane 337, Song-Jwu Rd., Taichung City (TW)

( * ) Notice: Subject to any disclaimer, the term of this patent is extended or adjusted under 35 U.S.C. 154(b) by 0 days.

(21) Appl. No.: 11/258,032

(22) Filed: Oct. 26, 2005

(65) Prior Publication Data

US 2007/0039426 A1 Feb. 22, 2007

(30) Foreign Application Priority Data

Aug. 19, 2005 (TW) ..... 94131818 A

(51) Int. Cl.
*B25B 23/157* (2006.01)

(52) U.S. Cl. ..... 81/475; 464/39

(58) Field of Classification Search ..... 81/473–476; 192/55.1, 56.1, 56.2; 464/37–39, 41, 45–47
See application file for complete search history.

(56) References Cited

U.S. PATENT DOCUMENTS 4,346,633 A * 8/1982 Rendl ..... 81/475

* cited by examiner

*Primary Examiner*—D. S. Meislin

(74) *Attorney, Agent, or Firm*—Troxell Law Office, PLLC

(57) ABSTRACT

A transmission member with torque-restricting protective structure, including: a first transmission section; a second transmission section kept spaced from the first transmission section by a predetermined distance; a first chucking section connected with the first transmission section and having a first chucking end facing the second transmission section; a second chucking section slidably connected with the second transmission section and linearly reciprocally movable between a chucking position and a releasing position, the second chucking section having a second chucking end, when the second chucking section is positioned in the chucking position, the second chucking end being engaged with the first chucking end, when the second chucking section is positioned in the releasing position, the second chucking end being disengaged from the first chucking end; a resilient member for resiliently locating the second chucking section in the chucking position; and an anti-rotating section disposed between the second chucking section and the second transmission section for preventing the second chucking section and the second transmission section from rotating relative to each other.

14 Claims, 15 Drawing Sheets

TRANSMISSION MEMBER WITH TORQUE-RESTRICTING PROTECTIVE STRUCTURE

BACKGROUND OF THE INVENTION

The present invention is related to a transmission measure of power tool, and more particularly to a transmission member with torque-restricting protective structure.

A conventional power torque tool is applicable to a work piece for wrenching or unscrewing the work piece. The power tool is generally equipped with a torque-adjusting mechanism or torque-restricting mechanism for adjusting/restricting the nominal torque value. Taiwanese Patent No. 092128742 discloses a socket with a nominal torque value. Ratchet wheels and a spring are disposed inside the socket. In the case that an excessively great torque is applied to the socket, the ratchet wheels are resiliently disengaged from each other to protect the work piece.

The socket of the above Patent has some shortcomings. For example, when tightening a work piece, the ratchet wheels cannot be truly disengaged from each other in the case of too great torque. This is because that the ratchet wheels are reversely displaced to disengage from each other. In the disengaged state, the distance between the ratchet wheels is enlarged. Two opposite ends of the ratchet wheels are respectively for coupling with an output end of a power supply and a work piece. Therefore, when the socket is bridged between the output end of the power supply and the work piece for wrenching/screwing the work piece, the distance between the output end of the power supply and the work piece is fixed. Basically, there is no further room for the two ratchet wheels to displace in reverse directions. Therefore, such socket can hardly truly achieve the torque-restricting protective effect.

SUMMARY OF THE INVENTION

It is therefore a primary object of the present invention to provide a transmission member with torque-restricting protective structure which can truly achieve torque-restricting protective effect.

It is a further object of the present invention to provide the above transmission member with torque-restricting protective structure capable of adjusting torque value according to the properties of a work piece.

According to the above objects, the transmission member with torque-restricting protective structure of the present invention includes: a first transmission section; a second transmission section kept spaced from the first transmission section by a predetermined distance; a first chucking section connected with the first transmission section and having a first chucking end facing the second transmission section; a second chucking section slidably connected with the second transmission section and linearly reciprocally movable between a chucking position and a releasing position, the second chucking section having a second chucking end, when the second chucking section is positioned in the chucking position, the second chucking end being engaged with the first chucking end, when the second chucking section is positioned in the releasing position, the second chucking end being disengaged from the first chucking end; a resilient member for resiliently locating the second chucking section in the chucking position; and an anti-rotating section disposed between the second chucking section and the second transmission section for preventing the second chucking section and the second transmission section from rotating relative to each other.

The present invention can be best understood through the following description and accompanying drawings wherein:

DETAILED DESCRIPTION OF THE PREFERRED EMBODIMENTS

Figure 1:
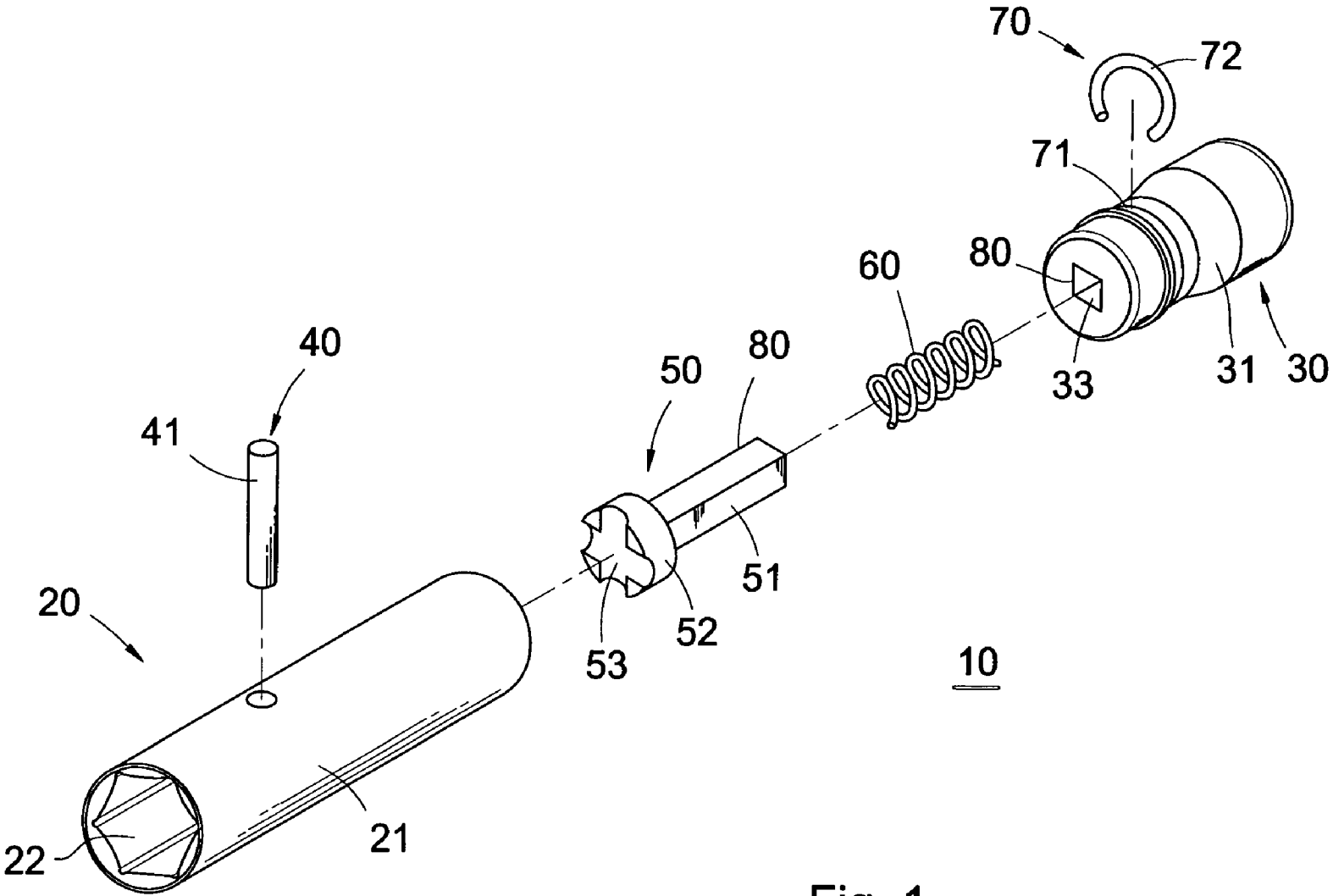
FIG. 1 is a perspective exploded view of a first embodiment of the present invention.
Figure 2:
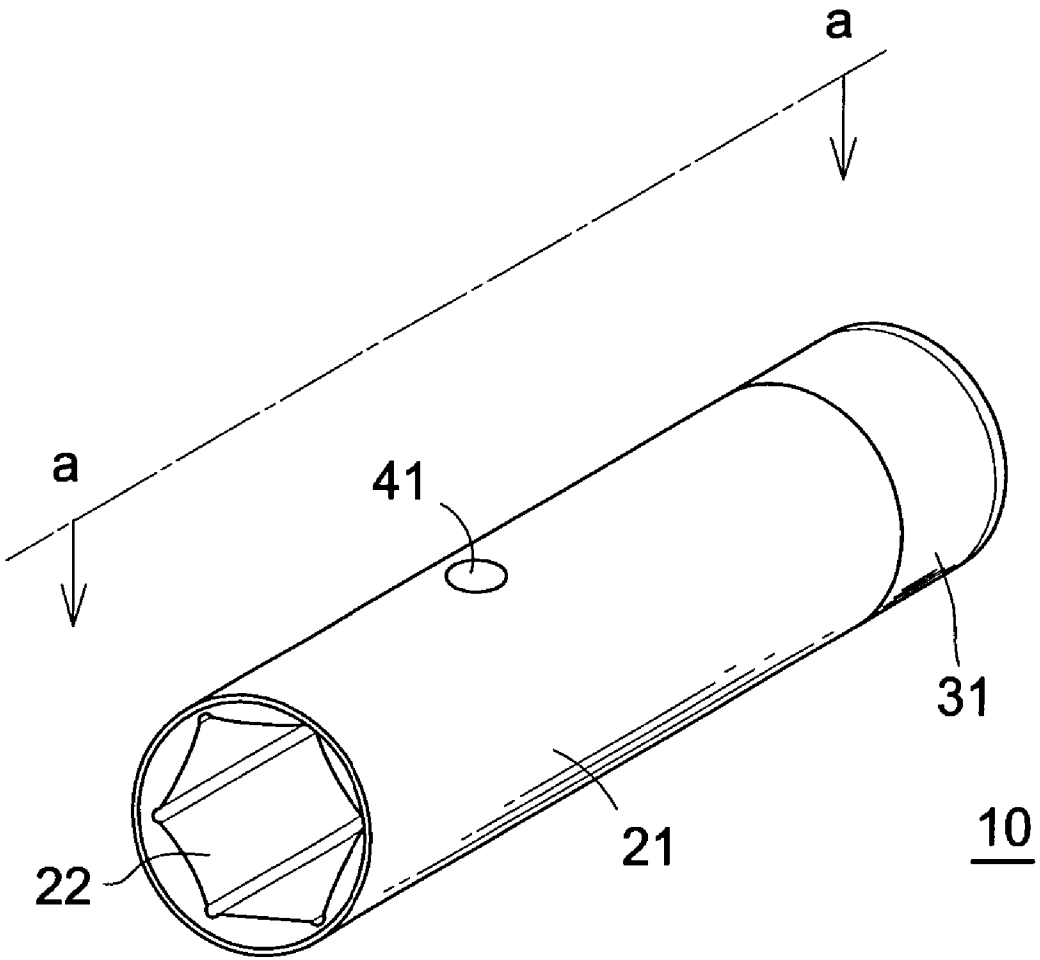
FIG. 2 is a perspective assembled view of the first embodiment of the present invention.
Figure 4:
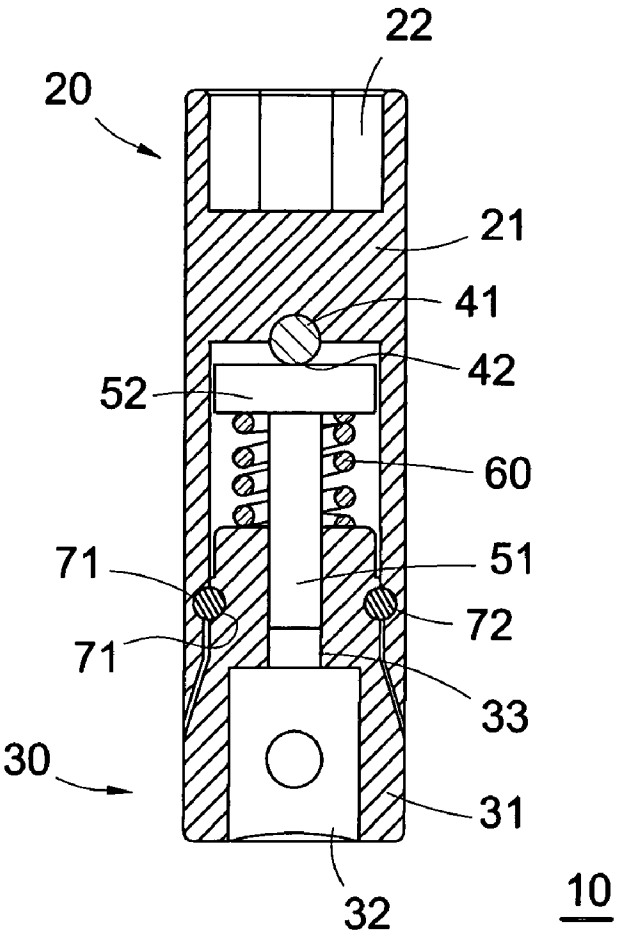
FIG. 4 is a sectional view taken along line a-a of FIG. 2, showing that the second chucking section is positioned in the releasing position.
Figure 3:
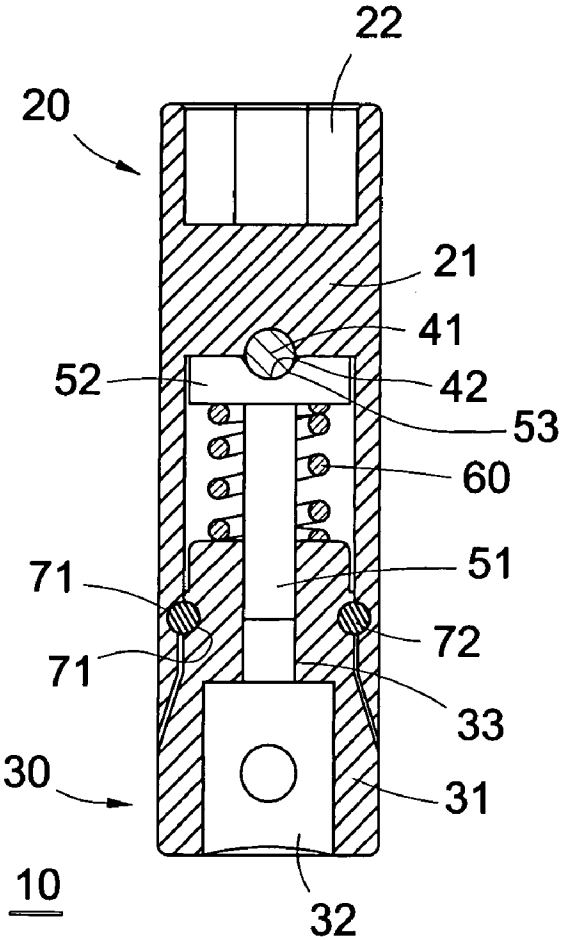
FIG. 3 is a sectional view taken along line a-a of FIG. 2, showing that the second chucking section is positioned in the chucking position.

Please refer to FIGS. 1 to 4. According to a first embodiment, the transmission member 10 with torque-restricting protective structure of the present invention includes a first transmission section 20, a second transmission section 30, a first chucking section 40, a second chucking section 50, a resilient member 60, a locating section 70 and an anti-rotating section 80.

The first transmission section 20 has a straight tubular body 21 with a certain length. A first end of the tubular body 21 is formed with a hexagonal hole serving as a first transmission end 22.

The second transmission section 30 has a column body 31. A first end of the column body 31 is coaxially accommodated in a second end of the tubular body 21. The second transmissions section 30 is rotatable about the axis of the tubular body 21. A second end of the column body 31 is formed with a square hole serving as a second transmission end 32. The first end of the column body 31 is formed with a slide hole 33 inward axially extending from the first end of the column body 31 to the second transmission end 32. The slide hole 33 communicates with the square hole of the second transmission end 32.

The first chucking section 40 is a pin member 41 with a certain length. The pin member 41 is transversely fixedly inserted through the tubular body 21 in a position adjacent to the first transmission end 22. One side of the pin member 41 facing the second transmission section 30 serves as a first engaging end 42.

The second chucking section 50 is received in the tubular body 21, having a slide stem 51. A first end of the slide stem 51 is coaxially slidably fitted in the slide hole 33. A circular second chucking block 52 is perpendicularly fixedly connected with a second end of the slide stem 51. One face of the second chucking block 52 is formed with chucking grooves serving as a second chucking end 53 in which the first chucking end 42 can be correspondingly chucked.

The resilient member 60 is a coiled spring fitted on the slide stem 51. Two ends of the resilient member 60 respectively abut against one face of the second chucking block 52 and the column body 31.

The locating section 70 includes two symmetrical annular grooves 71 respectively formed on a circumference of the column body 31 and an inner circumference of the tubular body 21. A C-shaped retainer ring 72 is inlaid in the annular grooves 71, whereby the column body 31 is axially located in the tubular body 21.

The slide stem 51 and the slide hole 33 have square cross-sections corresponding to each other to serve as the anti-rotating section 80. Accordingly, the slide stem 51 can only linearly reciprocally move along the axis of the slide hole 33.

Under the resilient force of the resilient member 60, the second chucking section 50 is movable to a chucking position where the first and second chucking ends 42, 52 are engaged with each other. Under such circumstance, the second transmission section 30 via the anti-rotating section 80 is drivingly connected with the second chucking section 50. Furthermore, via the first and second chucking ends 42, 52 engaged with each other, the power can be transmitted from the second transmission section 30 to the first transmission section 20.

An output end of a power torque tool can be inserted into the second transmission end 32 to provide rotational power thereto. Via the above power transmission structure, the power can be transmitted from the first transmission section 20 to a work piece to tighten or untighten the same. In the case that the value of the torque applied to the transmission member 10 exceeds the bearable resilient force of the resilient member 60, the second chucking section 50 is retracted from the chucking position to a releasing position. At this time, the second chucking end 52 is disengaged from the first chucking end 42 so as to avoid damage of the work piece due to excessively great torque.

According to the above arrangement, the transmission member 10 of the present invention achieves the torque-restricting protective effect by means of displacing the second chucking section 50. Therefore, the distance between the first and second transmission sections 20, 30 is unchanged so that the torque-restricting protective effect can be truly achieved.

Figure 5:
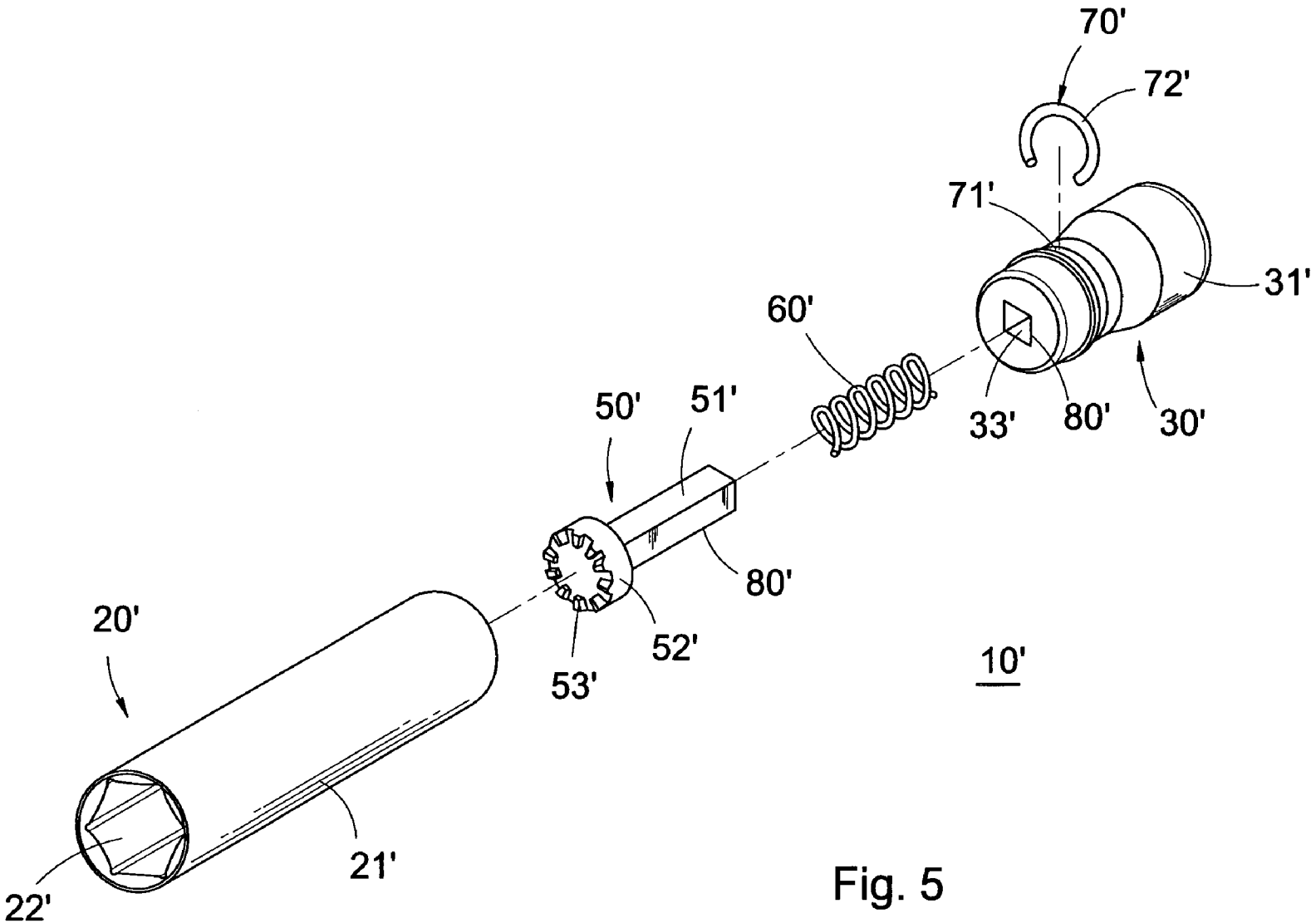
FIG. 5 is a perspective exploded view of a second embodiment of the present invention.
Figure 6:
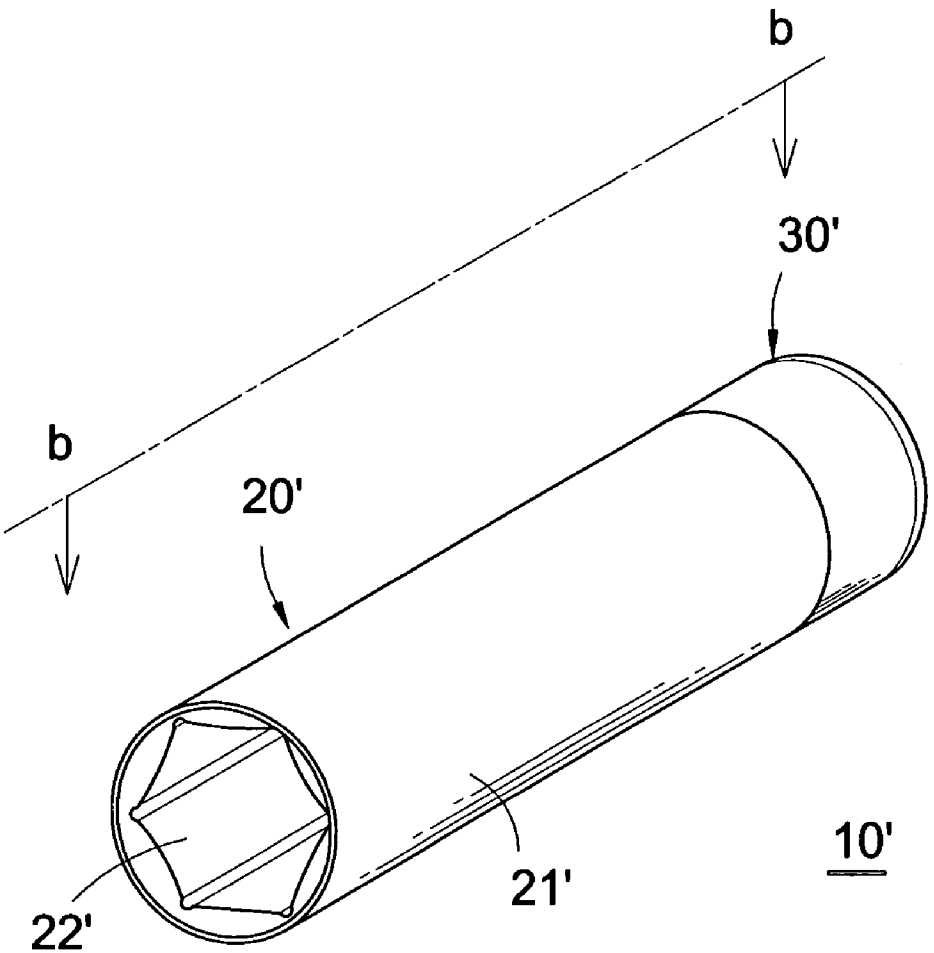
FIG. 6 is a perspective assembled view of the second embodiment of the present invention.
Figure 8:
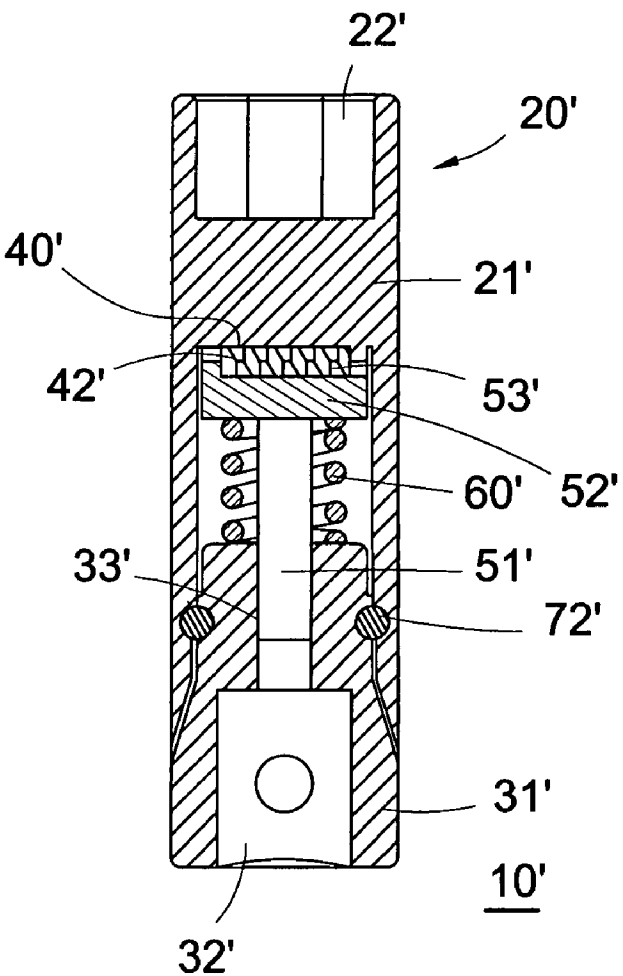
FIG. 8 is a sectional view taken along line b-b of FIG. 6, showing that the second chucking section is positioned in the releasing position.
Figure 7:
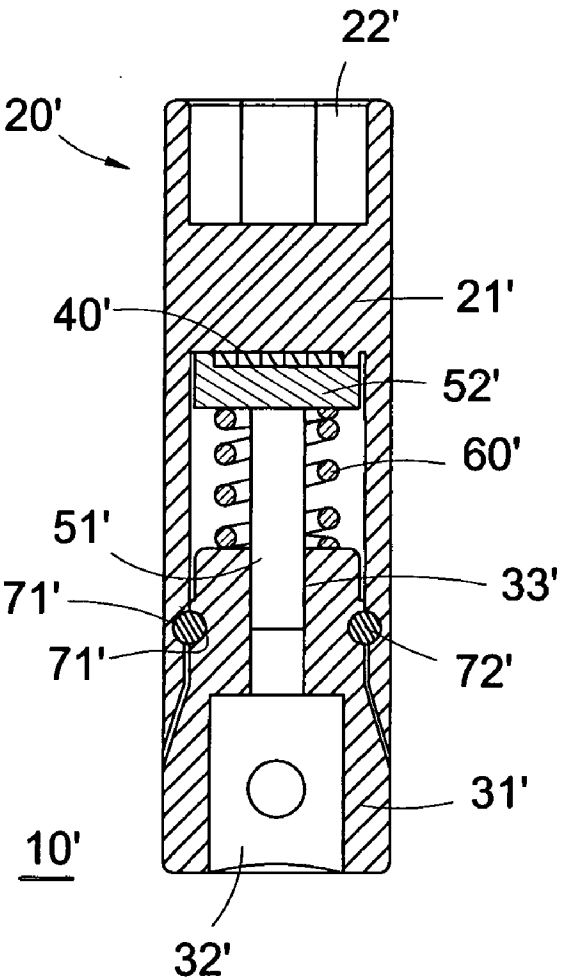
FIG. 7 is a sectional view taken along line b-b of FIG. 6, showing that the second chucking section is positioned in the chucking position.

FIGS. 5 to 8 show a transmission member 10' with torque-restricting protective structure of a second embodiment of the present invention. The only difference between the second and first embodiments is that the first and second chucking ends 42', 52' have different structures. Substantially, the first and second chucking ends 42', 52' of the second embodiment are ratchet structures complementary to and engaged with each other. Such structure can achieve the same effect as the first embodiment. Practically, the angle of one side of the ratchet is an obtuse angle, while the angle of the other side of the ratchet is a right angle. Generally, the torque-restricting protective is provided only in forward tightening operation. In the case of backward untightening operation, by means of the right angle design of the first and second chucking ends, the torque can be fully output. The shapes and angles of the ratchets can be modified as necessary without departing from the scope of the present invention.

Figure 9:
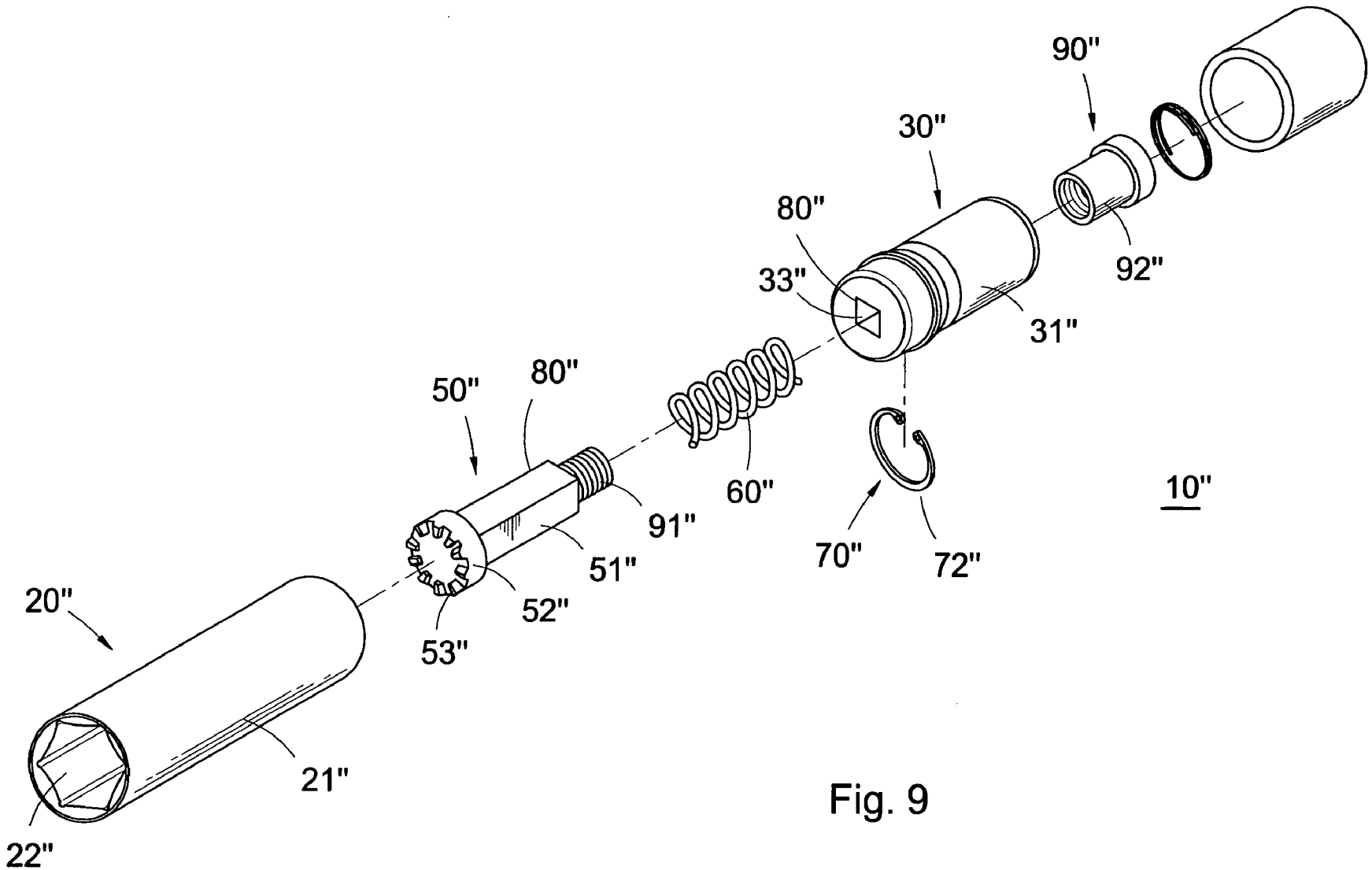
FIG. 9 is a perspective exploded view of a third embodiment of the present invention.
Figure 10:
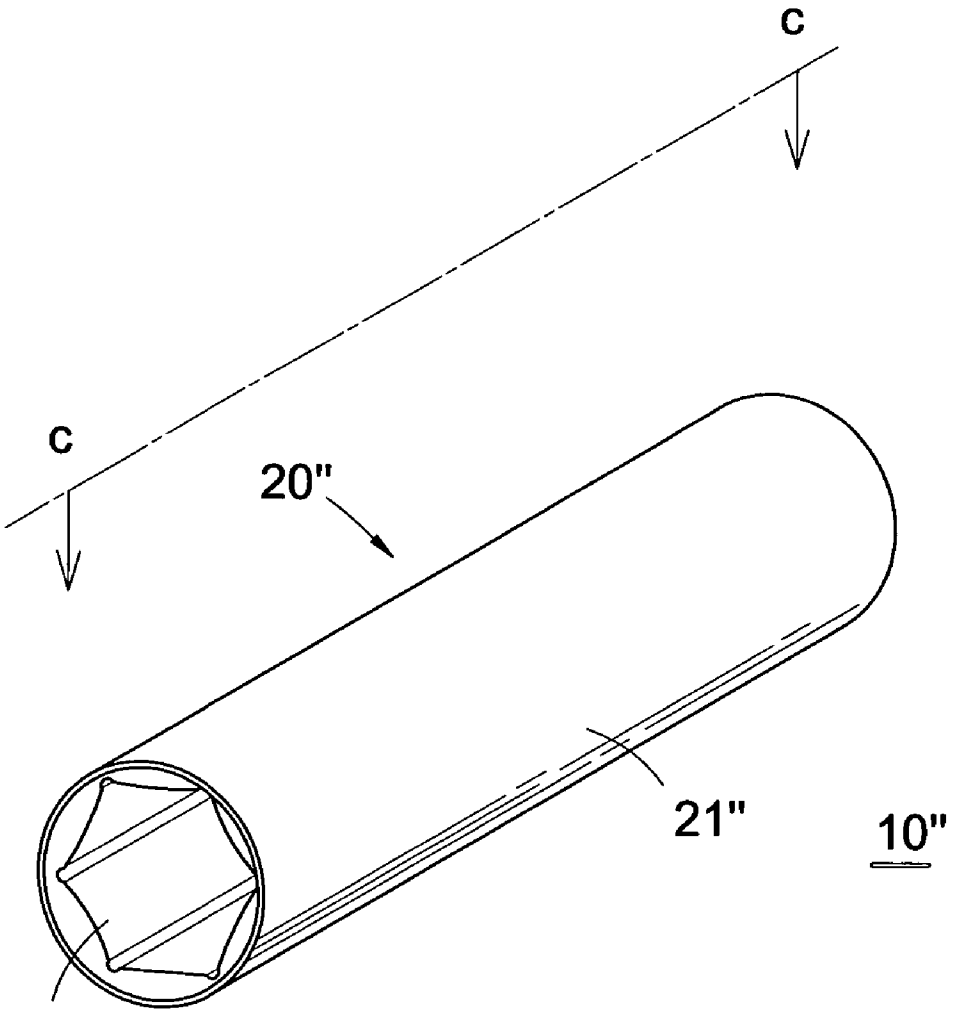
FIG. 10 is a perspective assembled view of the third embodiment of the present invention.
Figure 13:
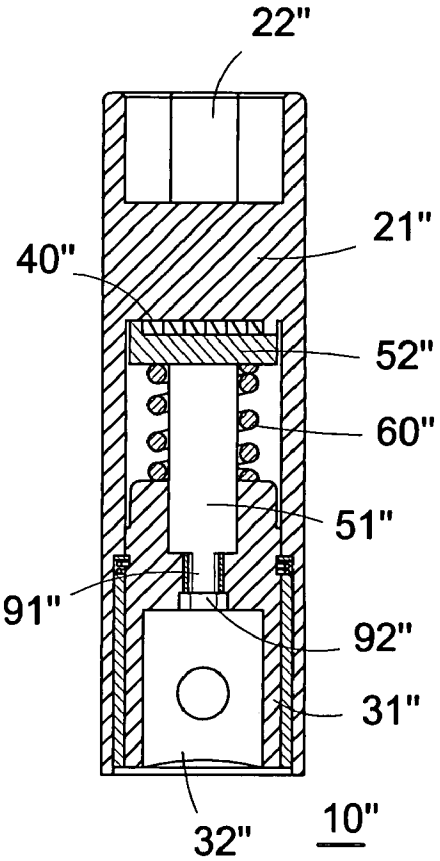
FIG. 13 is a sectional view taken along line c-c of FIG. 10, showing that the second chucking section is positioned in the chucking position after adjusted.
Figure 12:
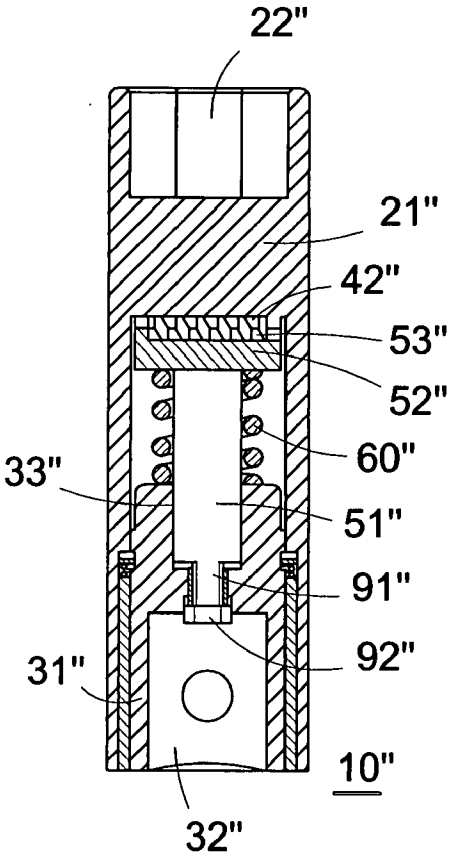
FIG. 12 is a sectional view taken along line c-c of FIG. 10, showing that the second chucking section is positioned in the releasing position.
Figure 11:
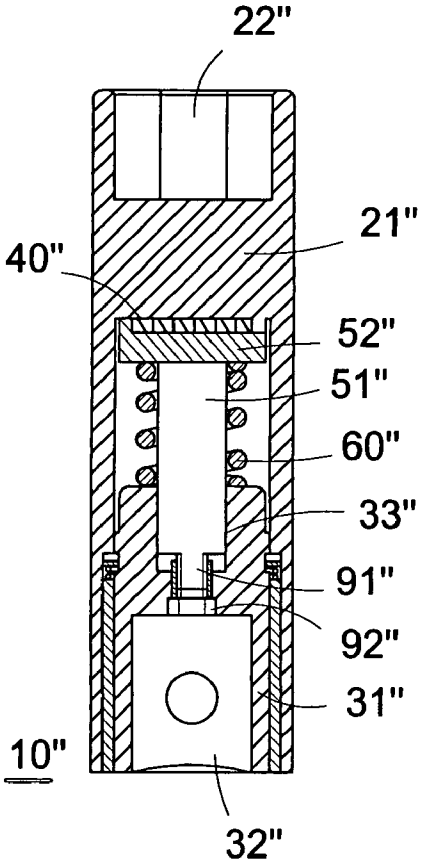
FIG. 11 is a sectional view taken along line c-c of FIG. 10, showing that the second chucking section is positioned in the chucking position.

FIGS. 9 to 13 show a transmission member 10" with torque-restricting protective structure of a third embodiment of the present invention, which is substantially identical to the second embodiment. The difference between the third and second embodiments is that the transmission member 10" further includes an adjustment section 90" for adjusting the maximum torque transmittable by the transmission member 10".

The adjustment section 90" includes an adjustment threaded rod 91" coaxially fixedly connected with the first end of the slide stem 51". The threaded rod 91" extends into the slide hole 33". The adjustment section 90" further includes an adjustment threaded bush 92" embedded in bottom wall of the second transmission end 32". A free end of the adjustment threaded rod 91" is screwed in the threaded bush 92", whereby the length of the slide stem 51" extending out of the slide hole 33" can be adjusted. Accordingly, the resilient member 60" can be compressed or released so as to adjust the value of the transmittable torque. In accordance with the change of the extending length of the slide stem 51", the position of the second transmission section 30" in the tubular body 21" must be also changed. However, this change is achievable only by means of rearranging the locating structure. The locating measure can be easily derived from the conventional technique and will not be further described hereinafter.

Figure 14:
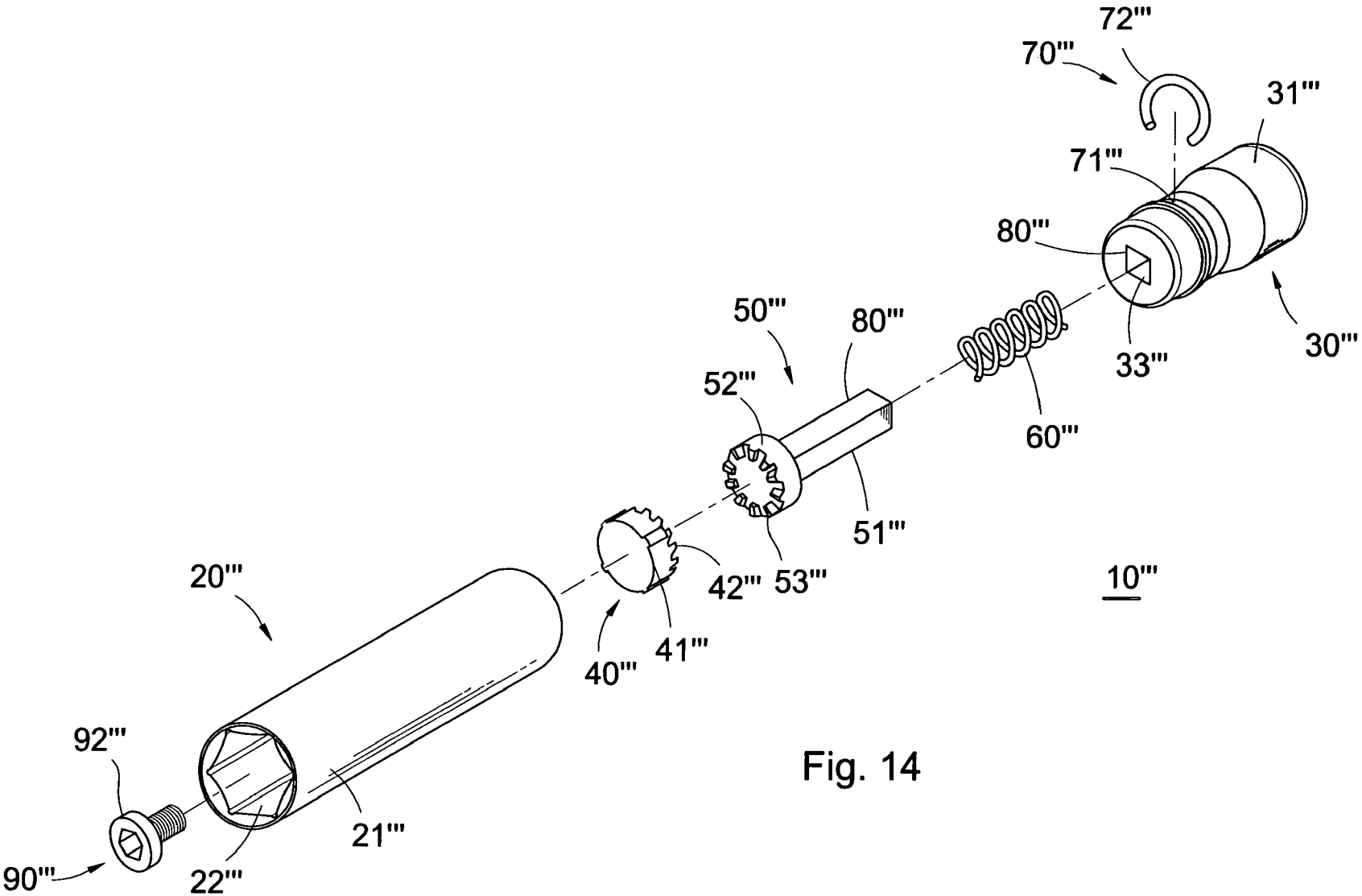
FIG. 14 is a perspective exploded view of a fourth embodiment of the present invention.
Figure 15:
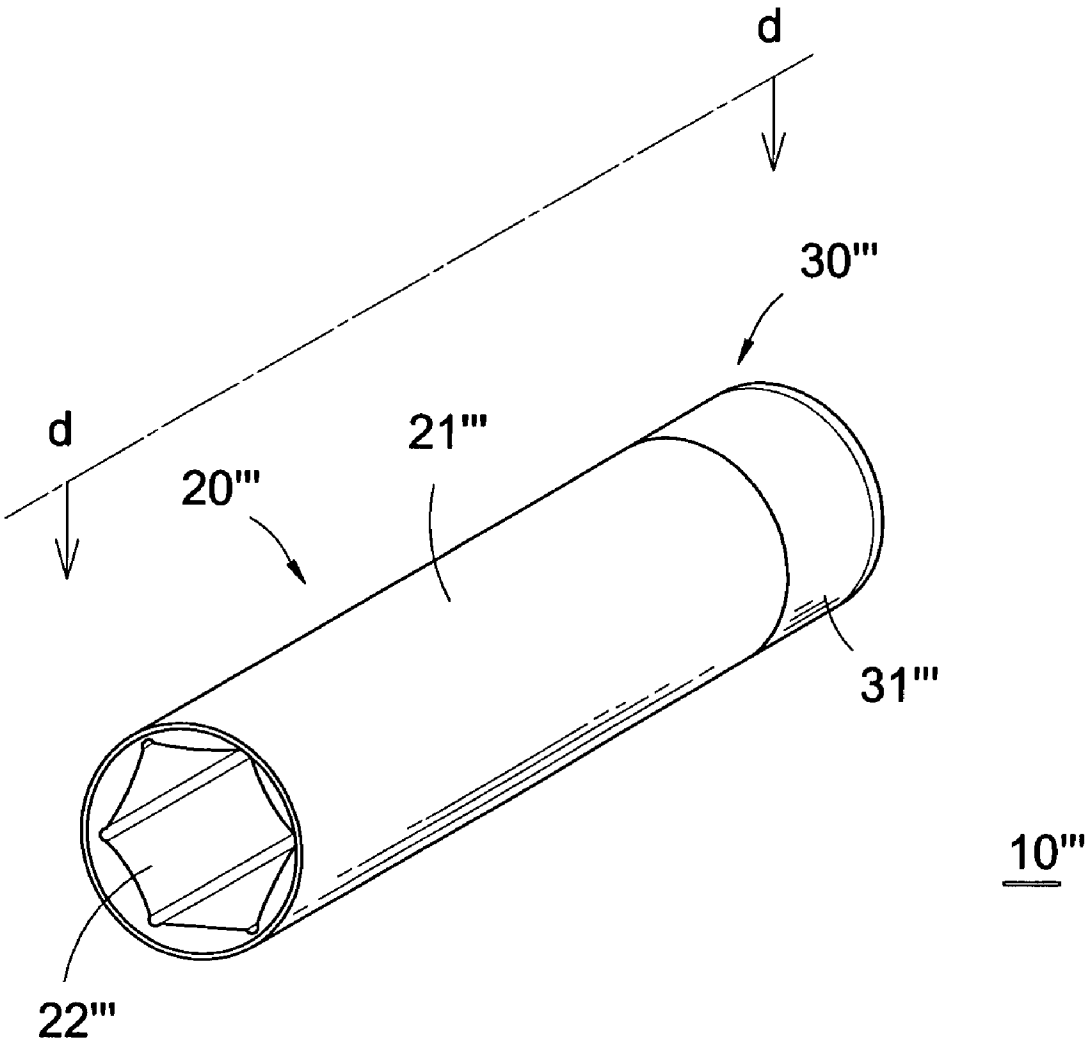
FIG. 15 is a perspective assembled view of the fourth embodiment of the present invention.
Figure 18:
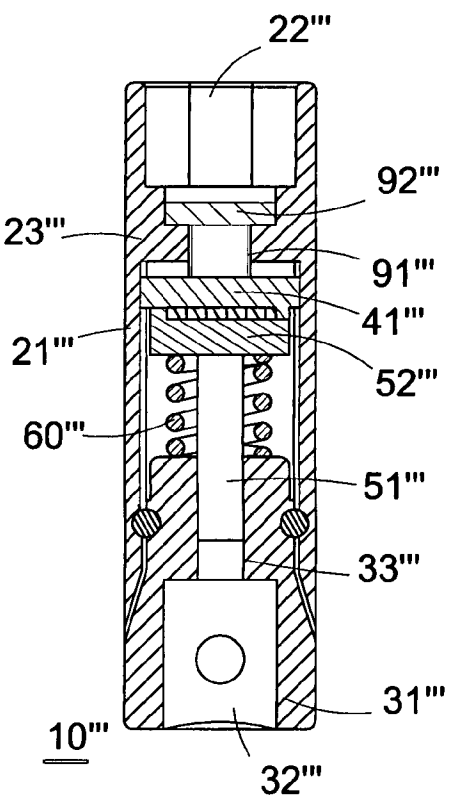
FIG. 18 is a sectional view taken along line d-d of FIG. 15, showing that the second chucking section is positioned in the chucking position after adjusted.
Figure 17:
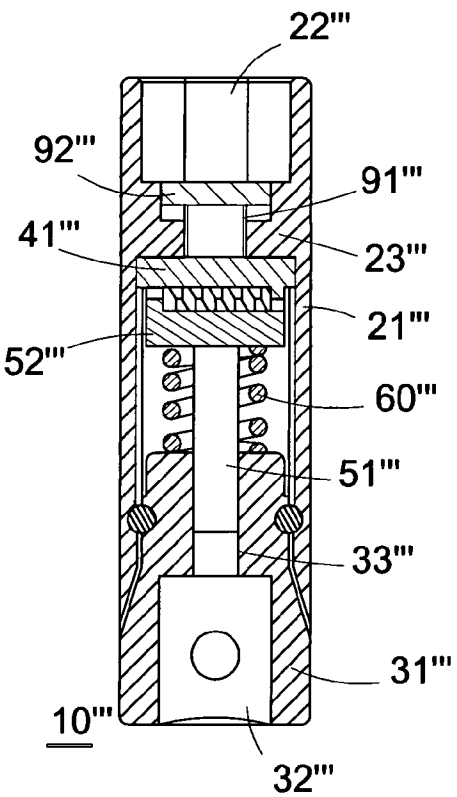
FIG. 17 is a sectional view taken along line d-d of FIG. 15, showing that the second chucking section is positioned in the releasing position.
Figure 16:
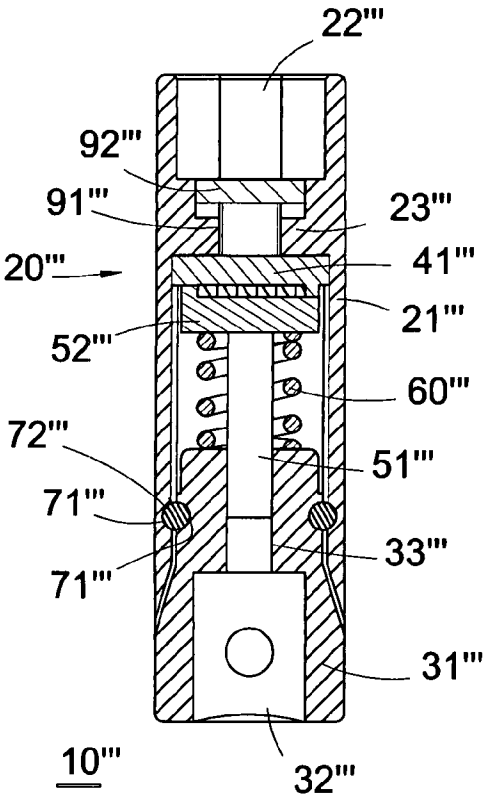
FIG. 16 is a sectional view taken along line d-d of FIG. 15, showing that the second chucking section is positioned in the chucking position.

FIGS. 14 to 18 show a transmission member 10'" with torque-restricting protective structure of a fourth embodiment of the present invention, which is substantially identical to the third embodiment. The difference between the fourth and third embodiments is that the adjustment section 90'" is different from that of the third embodiment.

In the fourth embodiment, the position of the first chucking section 40''' is changeable for adjust the value of the torque.

The first transmission section 20''' has a stop wall 23''' radially formed in the tubular body 21''' near the first transmission end 22'''. The stop wall 23''' has a certain thickness.

The first chucking section 40''' has a first chucking block 41''' axially movably fitted in the tubular body 21'''. One face of the first chucking block 41''' abuts against the stop wall 23'''.

The adjustment section 90''' has a thread hole 91''' formed through the stop wall 23''' and coaxial with the tubular body 21'''. An adjustment threaded rod 92''' is screwed in the thread hole 91'''. One end of the threaded rod 92''' extends out of the thread hole 91''' to abut against the first chucking block 41'''. Accordingly, when screwing the adjustment threaded rod 92''', the first chucking block 41''' is moved to another position in the tubular body 21'''. At the same time, the length of the slide stem 51''' extending out of the slide hole 33''' is synchronously adjusted. This can achieve the same effect as the third embodiment.

Figure 19:
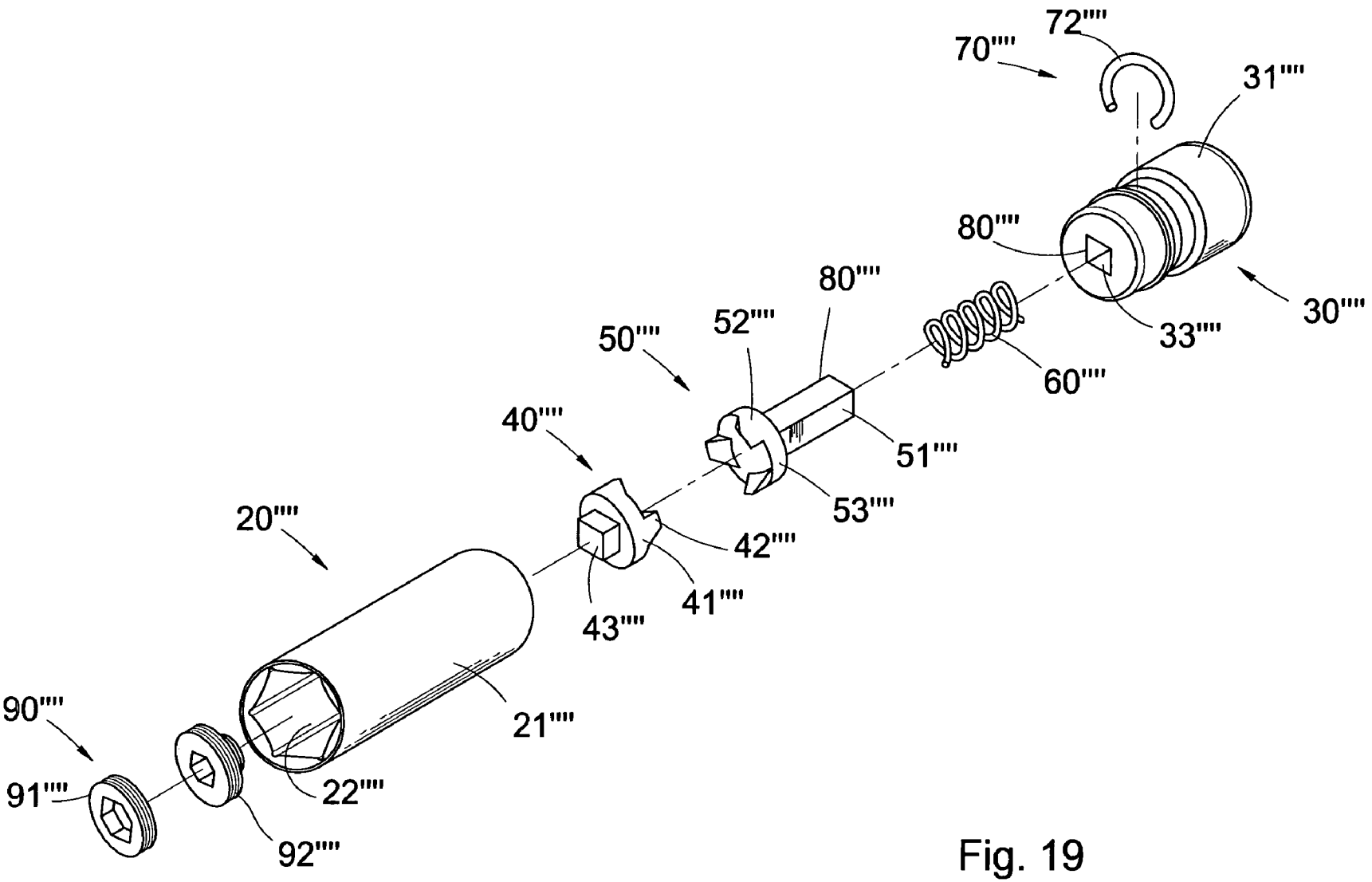
FIG. 19 is a perspective exploded view of a fifth embodiment of the present invention.
Figure 20:
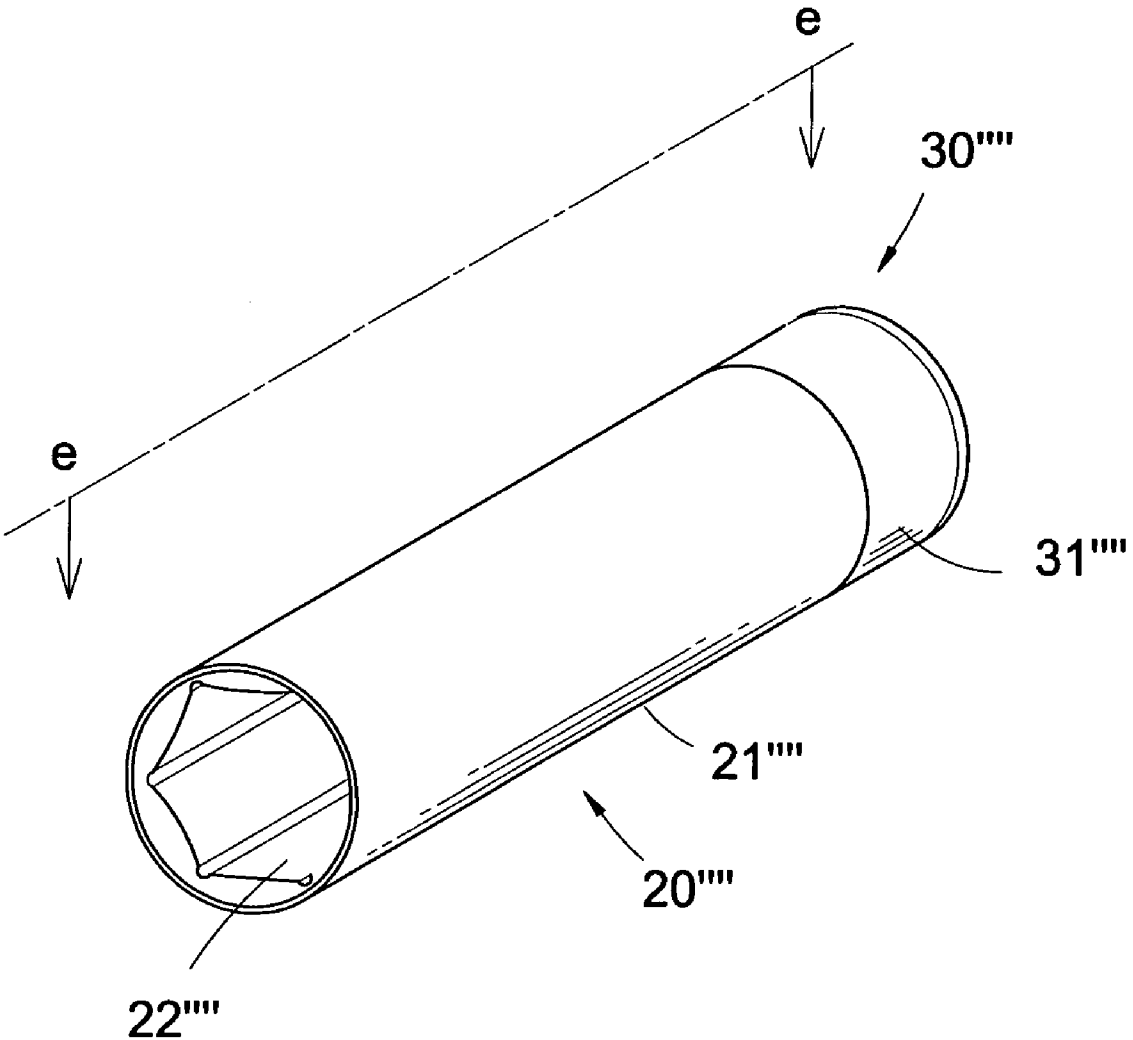
FIG. 20 is a perspective assembled view of the fifth embodiment of the present invention.
Figure 22:
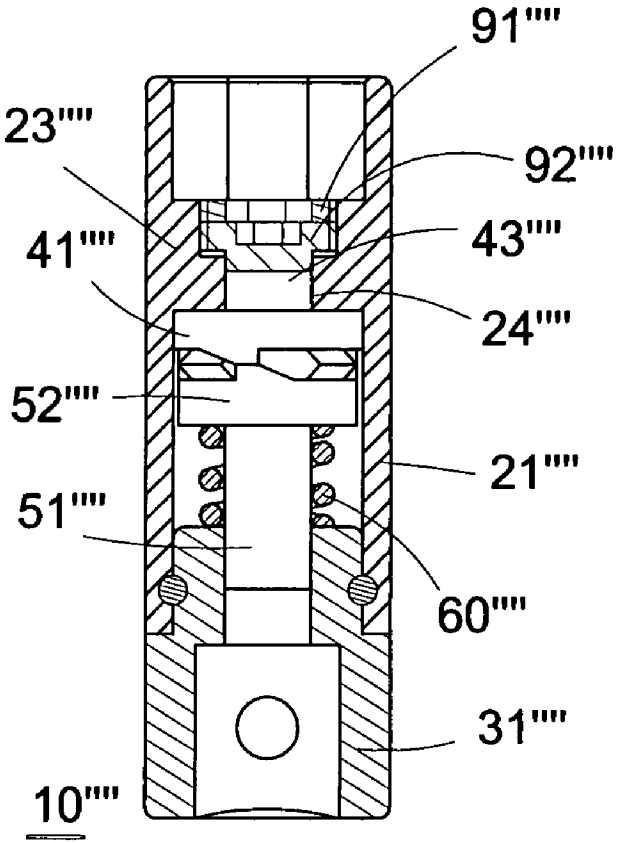
FIG. 22 is a sectional view taken along line e-e of FIG. 20, showing that the second chucking section is positioned in the releasing position.
Figure 21:
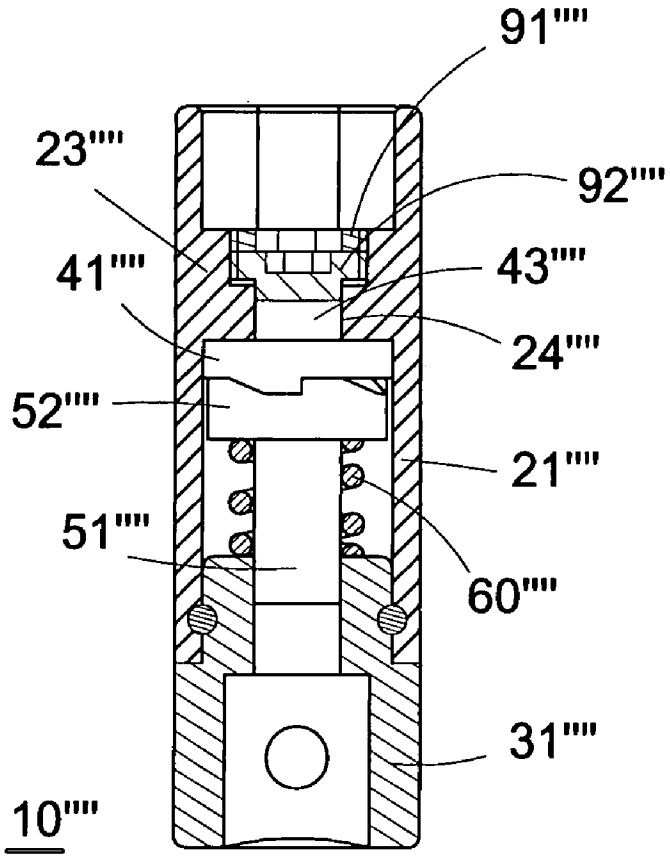
FIG. 21 is a sectional view taken along line e-e of FIG. 20, showing that the second chucking section is positioned in the chucking position.

FIGS. 19 to 22 show a transmission member 10'''' with torque-restricting protective structure of a fifth embodiment of the present invention, which is substantially identical to the fourth embodiment. There are two differences between the fifth and fourth embodiments as follows:

First, in the fifth embodiment, a square boss 43'''' is coaxially disposed on one face of the first chucking block 41'''' and fitted in a square hole 24'''' in the tubular body 21''''. Accordingly, the first chucking section 40'''' is axially movably fitted in the tubular body 21''''.

Second, in the fifth embodiment, the adjustment section 90'''' includes a first and second adjustment thread blocks 91'''', 92'''' coaxially screwed in the tubular body 21''''. One end of the second adjustment thread block 92'''' abuts against the square boss 43''''. By means of screwing the adjustment section 90'''', the range of the bearable torque can be adjusted. This can achieve the same effect as the fourth embodiment.

The above embodiments are only used to illustrate the present invention, not intended to limit the scope thereof. Many modifications of the above embodiments can be made without departing from the spirit of the present invention.

What is claimed is:

1. A transmission member with torque-restricting protective structure, comprising:

a first transmission section;

a second transmission section inserted into the first transmission section;

a first chucking section connected with the first transmission section and having a first chucking end facing the second transmission section;

a second chucking section slidably connected with the second transmission section and linearly reciprocally movable between a chucking position and a releasing position, the second chucking section having a second chucking end, when the second chucking section is positioned in the chucking position, the second chucking end being engaged with the first chucking end, when the second chucking section is positioned in the releasing position, the second chucking end being disengaged from the first chucking end;

a resilient member for resiliently locating the second chucking section in the chucking position; and an anti-rotating section disposed between the second chucking section and the second transmission section for preventing the second chucking section and the second transmission section from rotating relative to each other, wherein the first transmission section has a straight tubular body with a predetermined length, a first transmission end being disposed at a first end of the tubular body, wherein the first transmission end is a polygonal hole coaxial with the tubular body.

2. The transmission member with the torque-restricting protective structure as claimed in claim 1, wherein the second transmission section is accommodated and located in a second end of the tubular body, the second transmissions section being rotatable about an axis of the tubular body.

3. A transmission member with torque-restricting protective structure, comprising:

a first transmission section;

a second transmission section inserted into the first transmission section;

a first chucking section connected with the first transmission section and having a first chucking end facing the second transmission section;

a second chucking section slidably connected with the second transmission section and linearly reciprocally movable between a chucking position and a releasing position, the second chucking section having a second chucking end, when the second chucking section is positioned in the chucking position, the second chucking end being engaged with the first chucking end, when the second chucking section is positioned in the releasing position, the second chucking end being disengaged from the first chucking end;

a resilient member for resiliently locating the second chucking section in the chucking position; and an anti-rotating section disposed between the second chucking section and the second transmission section for preventing the second chucking section and the second transmission section from rotating relative to each other, wherein the first transmission section has a straight tubular body with a predetermined length, a first transmission end being disposed at a first end of the tubular body, wherein the second transmission section is accommodated and located in a second end of the tubular body, the second transmissions section being rotatable about an axis of the tubular body, further comprising a locating section including two symmetrical annular grooves respectively formed on an inner circumference of the tubular body and a circumference of the second transmission section, a retainer ring being inlaid in the annular grooves.

4. The transmission member with the torque-restricting protective structure as claimed in claim 2, wherein the second transmission section has a column body, a first end of the column body being coaxially accommodate din a second end of the tubular body, a second transmission end being disposed at a second end of the column body.

5. The transmission member with the torque-restricting protective structure as claimed in claim 4, wherein the second transmission end is a square hole coaxially formed on the second end of the column body.

6. A transmission member with torque-restricting protective structure comprising:

a first transmission section;

a second transmission section inserted into the first transmission section;

a first chucking section connected with the first transmission section and having a first chucking end facing the second transmission section;

a second chucking section slidably connected with the second transmission section and linearly reciprocally movable between a chucking position and a releasing position, the second chucking section having a second chucking end, when the second chucking section is positioned in the chucking position, the second chucking end being engaged with the first chucking end, when the second chucking section is positioned in the releasing position, the second chucking end being disengaged from the first chucking end;

a resilient member for resiliently locating the second chucking section in the chucking position; and an anti-rotating section disposed between the second chucking section and the second transmission section for preventing the second chucking section and the second transmission section from rotating relative to each other, wherein the second transmission section has a column body, a first end of the column body being formed with a slide hole inward axially extending from the first end of the column body, the second chucking section having a slide stem with a predetermined length, the slide stem being coaxially slidably fitted in the slide hole.

7. The transmission member with the torque-restricting protective structure as claimed in claim 6, wherein the slide stem and the slide hole have noncircular cross-sections corresponding to each other to serve as the anti-rotating section.

8. The transmission member with the torque-restricting protective structure as claimed in claim 6, wherein the resilient member is a spring fitted on the slide stem, two ends of the resilient member respectively abutting against one face of the second chucking block and the column body.

9. The transmission member with the torque-restricting protective structure as claimed in claim 8, further comprising an adjustment section for changing a distance between the second chucking end and the first end of the column body.

10. The transmission member with the torque-restricting protective structure as claimed in claim 9, wherein the adjustment section includes an adjustment threaded rod outward extending from the first end of the slide stem into the slide hole and an adjustment threaded bush disposed in second end fo the column body, the adjustment threaded rod being coaxially screwed in the threaded bush, whereby a length of the slide stem extending out of the slide hole is adjustable.

11. The transmission member with the torque-restricting protective structure as claimed in claim 8, wherein the first chucking section has a first chucking block with a predetermined shape, the first chucking block being axially movably fitted in the first transmission section to engage with the second chucking block.

12. The transmission member with the torque-restricting protective structure as claimed in claim 11, wherein the position of the first chucking block in the first transmission section is changeable, whereby the distance between the second chucking end and the first end of the column body is changeable.

13. The transmission member with the torque-restricting protective structure as claimed in claim 12, wherein a stop wall is radially formed in the tubular body near the first transmission end, one face of the first chucking block abutting against one face of the stop wall, the adjustment section having an adjustment thread hole formed through the stop wall and an adjustment thread hole formed through the stop wall and an adjustment threaded rod screwed from the other face of the stop wall into the thread hole, one end of the threaded rod extending out of the thread hole to abut against the first chucking block.

14. The transmission member with the torque-restricting protective structure as claimed in claim 1, wherein the first and second chucking ends are ratchet structures facing each other and engaged with each other.

* * * * *